US005770353A

United States Patent [19]

Wang et al.

[11] Patent Number: 5,770,353

[45] Date of Patent: Jun. 23, 1998

[54] PHOTOGRAPHIC ELEMENT HAVING IMPROVED FERROTYPING RESISTANCE AND SURFACE APPEARANCE

[75] Inventors: Yongcai Wang, Penfield; Alfred Bruce Fant, Rochester; Dennis Edward Smith, Rochester; Kurt Michael Schroeder, Rochester; Melvin Michael Kestner, Hilton, all of N.Y.

[73] Assignee: Eastman Kodak Company, Rochester, N.Y.

[21] Appl. No.: 673,433

[22] Filed: Jun. 28, 1996

[51] Int. Cl.[6] ..... G03C 11/06; G03C 1/32; G03C 3/00

[52] U.S. Cl. ..... 430/501; 430/523; 430/536; 430/537; 430/950; 430/512; 430/961; 430/931

[58] Field of Search ..... 430/536, 537, 430/501, 523, 496, 950, 512, 961, 931

[56] References Cited

U.S. PATENT DOCUMENTS

| | | | |
|---|---|---|---|
| 2,739,888 | 3/1956 | Sawdey | 430/15 |
| 3,287,289 | 11/1966 | Ream et al. | 524/24 |
| 3,352,681 | 11/1967 | Ohi et al. | 430/512 |
| 3,632,342 | 1/1972 | Salesin et al. | 430/496 |
| 3,707,375 | 12/1972 | Ohi et al. | 430/517 |
| 3,782,947 | 1/1974 | Krall | 430/21 |
| 4,199,363 | 4/1980 | Chen | 430/512 |
| 4,203,716 | 5/1980 | Chen | 430/207 |
| 4,214,047 | 7/1980 | Chen | 430/448 |
| 4,247,627 | 1/1981 | Chen | 430/512 |
| 4,279,945 | 7/1981 | Audran et al. | 427/130 |
| 4,294,739 | 10/1981 | Upson et al. | 430/70 |
| 4,497,917 | 2/1985 | Upson et al. | 523/201 |
| 4,990,276 | 2/1991 | Bishop et al. | 252/62.54 |
| 5,126,226 | 6/1992 | Fröhlich et al. | 430/257 |
| 5,147,768 | 9/1992 | Sakakibara | 430/501 |
| 5,173,730 | 12/1992 | Dieterich et al. | 354/275 |
| 5,210,001 | 5/1993 | Fröhlich et al. | 430/252 |
| 5,217,804 | 6/1993 | James et al. | 428/329 |
| 5,229,259 | 7/1993 | Yokota | 430/523 |
| 5,255,031 | 10/1993 | Ikenoue | 354/106 |
| 5,334,482 | 8/1994 | Aono | 430/203 |
| 5,336,589 | 8/1994 | Mukunoki et al. | 430/501 |
| 5,348,844 | 9/1994 | Garmong | 430/286 |
| 5,415,969 | 5/1995 | Waterman | 430/213 |
| 5,447,832 | 9/1995 | Wang et al. | 430/523 |
| 5,478,710 | 12/1995 | Müller et al. | 430/536 |
| 5,550,011 | 8/1996 | Fant et al. | 430/496 |
| 5,595,862 | 1/1997 | Fant et al. | 430/537 |

FOREIGN PATENT DOCUMENTS

| | | | |
|---|---|---|---|
| 613047 | 8/1994 | European Pat. Off. | G03C 1/76 |
| 4001784 | 7/1991 | Germany | G03C 7/32 |
| 6/266036 | 9/1994 | Japan | G03C 1/04 |

*Primary Examiner*—Mark F. Huff
*Attorney, Agent, or Firm*—Andrew J. Anderson

[57] ABSTRACT

Silver halide photographic elements are disclosed comprising a support having a front and a back side, at least one light-sensitive silver halide emulsion layer and a light-insensitive protective overcoat on the front side of the support, and a magnetic recording layer on the back side of the support, the light-insensitive protective overcoat comprising an outermost protective layer, wherein the outermost protective layer comprises a hydrophilic binder and dispersed particles having a mean size of less than 0.4 $\mu$m of a polymer having a glass transition temperature of at least 70° C. comprising units derived from monomers A and B at a weight ratio of A:B of from 97:3 to 80:20 and less than 3 wt % ionic monomers, where A represents ethylenically unsaturated monomers which form substantially water insoluble homopolymers and B represents ethylenically unsaturated non-ionic monomers capable of forming water soluble homopolymers. In preferred embodiments of the invention, the light-insensitive protective overcoat further comprises an ultraviolet absorbing layer, which is preferably positioned between the light sensitive silver halide emulsion layer and the outermost protective layer, and which preferably comprises an ultraviolet absorbing dye, a high boiling organic solvent, and a hydrophilic binder. The outermost protective layer preferably also comprises photographic process insoluble matte particles having a mean particle size of larger than 0.5 $\mu$m.

24 Claims, 1 Drawing Sheet

PHOTOGRAPHIC ELEMENT HAVING IMPROVED FERROTYPING RESISTANCE AND SURFACE APPEARANCE

FIELD OF THE INVENTION

This invention relates to an imaging element, and in particular to a silver halide photographic element containing a magnetic recording layer, having improved ferrotyping resistance and surface appearance.

BACKGROUND OF THE INVENTION

It is conventional to incorporate an absorbing dye, in particular, an ultraviolet ray absorbing dye, into a light-insensitive protective overcoat layer in a photographic element to absorb light in a specific wavelength region. The dyed light-insensitive layer is used, for example, to control the spectral composition of light incident upon a photographic emulsion layer. In addition, such dyed light-insensitive layer is used to absorb or to remove ultraviolet light produced by static discharge, which occurs when the surfaces of the photographic element come into contact during production or treatment processes. Electric charges are generated by friction of separation. When accumulation of static electricity by charging reaches a certain limiting value, atmospheric discharge occurs at a particular moment and a discharge spark fires at the same time. When the photographic element is exposed to light by discharging, static marks appear after development.

Different methods for incorporating absorbing dyes into a non-imaging layer have been described in, for example, U.S. Pat. Nos. 2,739,888, 3,352,681, and 3,707,375, where an oil soluble dye is dissolved in a high boiling organic solvent, and mixed under high shear or turbulence together with an aqueous medium, which may also contain a surfactant, and/or gelatin in order to break the organic phase into submicron particles dispersed in the continuous aqueous phase. While such method is efficient in forming dispersions of hydrophobic dyes, when such dye dispersions are used in a light-insensitive protective overcoat layer, the layer becomes soft and the mechanical properties of the layer are lowered. Furthermore, even if no high boiling solvent is used, many dyes themselves are liquid, and they therefore can have a detrimental effect on the mechanical properties of the layer and adhesion with the adjacent layer.

The weakening of light-insensitive protective overcoat layers by an absorbing dye/high boiling solvent dispersion, in particular by an ultraviolet absorbing dye dispersion, has been a serious problem in color light sensitive materials. Very often, another light-insensitive layer containing a matting agent is coated as the topmost layer above the light-insensitive layer containing the ultraviolet absorbing dye dispersions for better resistance to ferrotyping and sticking at high temperature and in moist environments. Photographic materials with such layer structures, however, still often show inferior physical and mechanical properties during various handling processes, such as coating, drying, finishing, winding, rewinding, printing, and so on. For example, the photographic material surfaces are easily harmed by contact friction with other apparatus and between their front and back faces. Scratches and abrasion marks can be generated. These generated scratches and abrasion marks deface the image during printing and projection processes. On irreplaceable negatives, the physical scratches may require very expensive retouching.

In recent years, the conditions under which photographic materials are manufactured or utilized have become even more severe, either because their applications have been extended, for example, in an atmosphere of high humidity and high temperature, or because the methods for their preparation have been advanced, for example, the use of high speed coatings, high speed finishing and cutting, and fast processing, or because their emulsion layers have been progressively thinned. Under these conditions, the aforementioned photographic materials may be even more severely scratched.

It is also known from, e.g., U.S. Pat. Nos. 3,782,947, 4,279,945, 4,990,276, 5,217,804, 5,147,768, 5,229,259, 5,255,031, and others that a radiation-sensitive silver halide photographic element may contain a photographically transparent magnetic recording layer which can advantageously be employed to record information into and read information from the magnetic recording layer by techniques similar to those employed in the conventional magnetic recording art. The use of a magnetic recording layer for information exchange allows improved photographic print quality through input and output of information identifying the light-sensitive material, photographic conditions, printing conditions and other information. Such magnetic recording layers are typically coated on the backside of a support opposite to the silver halide emulsion layers of the photographic element.

Recent patents have also disclosed photographic systems where processed photographic element may be re-introduced into a film cassette. Such systems are particularly useful in combination with photographic elements having magnetic recording layers, such as those designed for use with the recently announced Advanced Photo Systems™. This system allows for compact and clean storage of the processed element until such time when it may be removed for additional prints or to interface with display equipment. Storage in the cassette is preferred to facilitate location of the desired exposed frame and to minimize contact with the negative during subsequent usage. U.S. Pat. No. 5,173,730, e.g., discloses a cassette designed to thrust the photographic element from the cassette, eliminating the need to contact the film with mechanical or manual means. U.S. Pat. No. 5,336,589 describes how developed photographic film comprising a magnetic recording layer may be stored in such a cassette.

Reading of information recorded in a magnetic recording layer of a photographic element by passing over a magnetic head involves higher pressures on the side of the photographic film opposite to the magnetic recording layer then typically otherwise experienced during processing of photographic elements. This places a greater demand upon the protective overcoats which are typically coated over the emulsion layers of an element on the side of the film opposite to the magnetic recording layer. Also, the reintroduction of processed photographic elements into thrust cassettes can additionally cause scratches and abrasion marks.

Also, in recent years, rapid processing and high temperature drying after processing have become common practice for photographic materials. Films dried at high temperatures, for example 60° C. (harsh drying), tend to be more prone to ferrotyping which results from close contact, especially under elevated humidity and temperature. When ferrotyping is sufficiently severe, the resulting prints are unacceptable. Films dried at lower temperatures, for example 40° C. (mild drying), tend to show much less ferrotyping. The reason for this difference is not understood. The dimensions of the so-called thrust cassette also requires the processed photographic element to be wound tightly and under pressure, causing direct close contact between the front and back sides, which can result in ferrotyping, especially under high temperature and high relative humidity conditions.

It is known to use synthetic polymer particles in a silver halide photographic element to improve physical characteristics. In particular, water-insoluble polymers dispersed in the form of very small particles and obtained by emulsion polymerization techniques (polymer latex particles) have found wide use as partial replacements for gelatin. For example, it has been proposed to use polymer latex particles in both the hydrophilic light-sensitive layers and hydrophilic light-insensitive layers to improve the element dimensional stability, to improve the element drying characteristics during photographic processing, to improve layer adhesion and flexibility, to reduce pressure fog, to control dye and image stability, to carry photographic useful compounds such as dyes, couplers, accelerators, hardeners, etc., and to improve the scratch and abrasion resistance of photographic layers, in particular surface protective layers.

Many latex polymers, however, have been found to be incompatible or unstable for effective coating in protective overcoat layers coated from hydrophilic colloid solutions such as gelatin solutions. It is known to include various addenda, such as salts, surfactants, thickeners, inorganic fillers, organic solvents, etc., in photographic elements, and the presence of these various compounds in a coating solution containing a polymer latex dispersion may significantly reduce the stability of polymer latex particles, for example, by reducing the electrostatic repulsion force from the interaction between electrical double layers or surface charges on the particles. Surfactants may carry opposite charges to those on the polymer latex particle surface leading to latex particle flocculation through charge neutralization.

The level of hydrodynamic stress and mechanical energy applied to a coating solution may also cause failure of solutions containing a polymer latex during coating processes, where high shear forces are generated by forcing the coating solution through mechanical pumps, ultrafine filters, narrow orifices, mechanical degassing systems, coating hoppers, etc. Latex polymer particle instability and flocculation, and eventually coagulation, can have a significant effect on manufacturing processes such as filtering and delivering of the coating solutions. The failure of a solution is manifest in the deposition of debris as sticky or gritty particles which ultimately can cause filter blockage, thereby reducing the efficiency of the coating process. Further, photographic characteristics may be damaged, leading to, e.g., desensitization of silver halide emulsions, dye stain after development, spot defects and displaced developed grains. If the spot defects appear in the surface protective layer, it may lead to unacceptable surface haze.

Various methods have been proposed to improve the stability of polymer latex particles in coating solutions, for example, by addition of extra surfactants to the coating solution, by using surfactant mixtures, or by using polymer latex particles prepared by emulsion polymerization in the presence of a water-soluble high molecular weight material. However, adding extra surfactant can result in a significant increase in foaming of the coating solution. Extra surfactants used to stabilize the latex may also diffuse to the surface of the photographic materials causing undesirable surface charging properties. The use of high molecular weight water-soluble polymers, although useful for improving latex particle stability, can cause problems, such as, coating solution viscosity increase, deterioration of scratch resistance and ferrotyping protection.

It has been heretofore known to employ latex polymer particles in photographic elements that are compatible with gelatin. U.S. Pat. No. 3,287,289, e.g., describes a use of a copolymer of at least one acid selected from acrylic acid or methacrylic acid, and at least one ester selected from acrylate, tertiary butyl acrylate, amyl acrylate, or hexyl acrylate. Use of many latex polymers which are compatible in gelatin solutions for protective overcoats, however, has been found to frequently provide unacceptable post-processing ferrotyping protection, especially for elements having magnetic recording layers which are reintroduced into a cassette after processing.

PROBLEMS TO BE SOLVED BY THE INVENTION

Therefore, an objective of the present invention is to provide a silver halide photographic material comprising a magnetic recording layer, which element exhibits excellent resistance to physical scratches and abrasions. It is a further object of the present invention to provide such an element comprising polymer latex particles having excellent stability with respect to the manufacturing process of photographic materials. Another object is to provide such elements without causing additional haze or generating spot defects harmful to photographic performance of the element. It is a further object to provide such photographic elements having excellent post-processing physical properties such as scratch resistance and ferrotyping protection. It is yet a further object of the present invention to provide a cassette which contains a processed photographic element with excellent image quality and superior resistance to sticking and ferrotyping between front and back sides even at high temperatures and in moist environments.

SUMMARY OF THE INVENTION

In accordance with one embodiment of the present invention, a silver halide photographic element is disclosed comprising a support having a front and a back side, at least one light-sensitive silver halide emulsion layer and a light-insensitive protective overcoat on the front side of the support, and a magnetic recording layer on the back side of the support, the light-insensitive protective overcoat comprising an outermost protective layer, wherein the outermost protective layer comprises a hydrophilic binder and dispersed particles having a mean size of less than 0.4 $\mu$m of a polymer having a glass transition temperature of at least 70° C. comprising units derived from monomers A and B at a weight ratio of A:B of from 97:3 to 80:20 and less than 3 wt % ionic monomers, where A represents ethylenically unsaturated monomers which form substantially water insoluble homopolymers and B represents ethylenically unsaturated non-ionic monomers capable of forming water soluble homopolymers.

In accordance with further embodiments of the present invention, a process is disclosed comprising exposing and developing a photographic element as described above supplied in a photographic film cassette, and reintroducing the resulting developed element into the photographic film cassette, as well as photographic film cassettes containing an exposed and developed photographic element obtained from such process.

In preferred embodiments of the invention, the light-insensitive protective overcoat further comprises an ultraviolet absorbing layer, which is preferably positioned between the light sensitive silver halide emulsion layer and the outermost protective layer, and which preferably comprises an ultraviolet absorbing dye, a high boiling organic solvent, and a hydrophilic binder. The outermost protective layer preferably also comprises photographic process insoluble matte particles having a mean particle size of larger than 0.5 μm.

DETAILED DESCRIPTION

Figure 1:
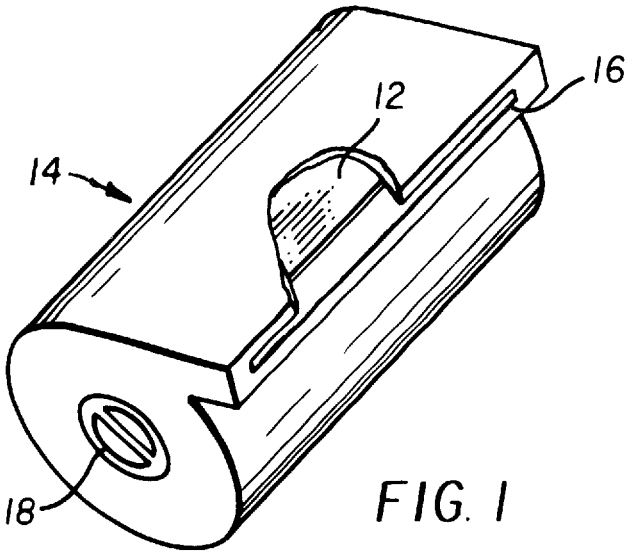
FIG. 1 is a partially cutaway perspective view of a cassette containing a processed photographic element in accordance with one embodiment of the invention.

Photographic elements according to this invention can differ widely in structure and composition. For example, they can vary greatly in regard to the type of the support, the number and composition of the imaging forming layers, and the kinds of auxiliary layers that are included in the elements. The invention is particularly applicable to photographic elements comprising polymeric film supports. Typical polymeric film supports include cellulose nitrate film, cellulose acetate film, poly(vinyl acetal) film, polystyrene film, polyester films such as poly(ethylene terephthalate) film and poly(ethylene naphthalate) film, polycarbonate film, and the like.

The photographic element of the present invention has a light-insensitive hydrophilic outermost protective layer containing dispersed fine polymer particles and a hydrophilic binder. The outermost layer preferably also comprises permanent (photographic process insoluble) matte particles, preferably having a mean particle size of from 0.5 to 10 μm, more preferably from 1 to 5 μm, and most preferably from 1 to 3 μm, and a coating weight of from 0.001 $g/m^2$ to 0.3 $g/m^2$, preferably from 0.003 $g/m^2$ to 0.2 $g/m^2$, and most preferably from 0.005 to 0.15 $g/m^2$. The dispersed polymer particles in the outermost protective layer in accordance with the invention have a glass transition temperature (Tg) of at least 70° C., and a mean particle size of less than 0.4 μm, preferably from 0.01 μm to 0.2 μm, more preferably from 0.02 to 0.15 μm, and most preferably from 0.02 to 0.1 μm. The weight ratio of dispersed polymer particle to hydrophilic binder in the outermost protective layer ranges from 5:95 to 50:50, preferably from 10:90 to 40:60, and most preferably from 20:80 to 40:60.

Any suitable ethylenically unsaturated monomers may be used for the preparation of dispersed polymer particles of the present invention as long as the stated glass transition temperature requirement and monomer weight ratios and percentages are maintained. In accordance with the invention, A represents "hydrophobic monomers" which would form a substantially water-insoluble homopolymer, and B represents "hydrophilic monomers" which are capable of forming substantially water soluble homopolymers. While use of pure hydrophobic polymers having a glass transition temperature (Tg) of at least 70° C. (preferably at least 80° C.) would be desirable for providing good ferrotyping protection, such polymers are generally not compatible for coating in hydrophilic colloid solutions. High Tg copolymers of hydrophobic monomers and ionic hydrophilic monomers generally require more than 3 weight percent ionic monomer to provide acceptable compatibility in protective overcoat layers to prevent surface defects. Such high levels of ionic monomer, however, result in poorer post-processing ferrotyping protection.

When used in the surface protective layer of a photographic element, dispersed polymer particles in accordance with the invention result in good compatibility with hydrophilic colloids such as gelatin and other additives such as matte, lubricants, coating surfactants, charge control agents, etc., few surface defects, and excellent post-processing ferrotyping protection. In accordance with a preferred embodiment of the invention, polymer latexes are used comprising from 80–97 weight percent A monomers (preferably 85–95 weight percent and more preferably 90–95 weight percent), 3–20 weight B monomers (preferably 5–15 weight percent and more preferably 5–10 weight percent), and less than 3 weight percent ionic monomers (preferably less than 2 weight percent).

Suitable ethylenically unsaturated monomers which can be used as component A of the present invention include, for example, the following monomers and their mixtures: alkyl esters of acrylic or methacrylic acid (i.e., alkyl (meth) acrylates) such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitriles of the same acids such as acrylonitrile and methacrylonitrile. Other monomers which may be used, either alone or in admixture with these acrylic monomers, include vinyl acetate, vinyl propionate, vinylidene chloride, vinyl chloride, and vinyl aromatic compounds such as styrene, t-butyl styrene and vinyl toluene. Other comonomers which may be used in conjunction with any of the foregoing monomers include dialkyl maleates, dialkyl itaconates, dialkyl malonates, isoprene, and butadiene. Crosslinking and grafting comonomers which may be used together with the forgoing monomers to crosslink the polymer particles to effectively increase their glass transition temperature include monomers which are polyfunctional with respect to the polymerization reaction, including esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, dienes such as butadiene and isoprene, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctional aromatic compounds such as divinyl benzene.

Suitable ethylenically unsaturated non-ionic hydrophilic monomers which can be used as component B of the present invention include, for example, (meth)acrylamides such as acrylamide, methacrylamide, N,N-dimethyl acrylamide, N-methyl acrylamide, N-isopropyl acrylamide, and N-methylol acrylamide. Additional suitable hydrophilic monomers include poly(ethylene glycol) methacrylate, poly (ethylene glycol) ethyl ether methacrylate, poly(ethylene glycol) phenyl ether acrylate, 2-poly(ethylenoxy)ethyl acrylate, vinylimidazole, N-vinyl-2-pyrrolidone, and the like.

Ethylenically unsaturated ionic monomers which may be present at less than 3 wt % in the dispersed polymer particles in accordance with the present invention may include, for example, monomers containing carboxylic acid, sulfo, or oxysulfo pendent groups, or salts of such groups (e.g., ammonium or alkali metal salts). Representative monomers include methacrylic acid and sodium acrylamido-2-methylpropane sulfonate.

Preferred polymers for use in the outermost protective layer in accordance with the invention comprise copolymers of alkyl (meth)acrylates and (meth)acrylamides. Particularly preferred polymers comprise copolymers of methyl methacrylate and methacrylamide or N,N-dimethyl acrylamide.

The dispersed polymer particles can be made by various processes well-known in the art (see, for example, Padget, J. C. in *Journal of Coating Technology*, Vol 66, No. 839, pages 89–105, 1994; Arnoldus, R. in *Waterbourn Coatings, Surface Coating*-3, Ed. by Wilson, A. D., Nicholson, J. W., Prosser, H. J., Elsevier Applied Science, 1990, page 179; El-Aasser, M. S. and Fitch, R. M. Ed. *Future Directions in Polymer Colloids*, NATO ASI Series, No 138, Martinus Nijhoff Publishers, 1987, pages 3–104), and are most preferably made by an emulsion polymerization process.

The dispersed polymer particles in the present invention can be made in the presence of a certain amount of prepolymers, or functionalized oligomers, or macromonomers, which may include, for example, functionalized organosiloxanes prepared by reactions between organohydrosiloxane and multifunctional unsaturated monomers, fluorine-containing polymers, polyester urethanes, polyether urethanes, polyacrylourethanes, and the like, so long as the resulting polymer particles are sufficiently water-insoluble so as to not be removed to a significant extent during photographic processing. The dispersed polymer particles of the present invention can contain one phase or two or more incompatible phases. The incompatibility may be determined in various ways known in the art. The use of electron microscopy using staining techniques to emphasize the differences between the appearance of the phases, for example, is such a technique.

The glass transition temperature of the dispersed polymer particles of the present invention can be measured by various well-known techniques such as, for example, dilatometry, calorimetry (differential thermal analysis and differential scanning calorimetry), dielectric, and dynamical mechanical measurements. Such techniques have been described in detail in, for example, Rabek, J. F., *Experimental Methods in Polymer Chemistry*, Wiley-Interscience, Chichester, 1980.

Various permanent matting agents for use in the outermost layer of the photographic element in accordance with preferred embodiments of the present invention include, for example, inorganic particles such as silicone dioxide, barium sulfate, desensitized silver halide, zinc particles, calcium carbonate, and the like; organic particles of cellulose esters, cellulose ethers, starches, addition-type polymers and interpolymers prepared from ethylenically unsaturated monomers such as acrylates including acrylic acid, methacrylates including methacrylic acid, acrylamides and methacrylate amides, itaconic acid and its half esters and diesters, styrenes including substituted styrenes, acrylonitriles and methcrylonitriles, vinyl acetates, vinyl ethers, vinyl and vinylidene halides and olefins. The matte particles can be crosslinked by employing crosslinking monomers such as 1,4-butyleneglycol methacrylate, trimethylolpropane triacetate, allyl methacrylate, diallyl phthalate, divinyl benzene, and the like. Other polymers that may comprise matting particles include condensation polymers such as polyurethanes, polyesters, polyamides, epoxies, and the like. Matte particles useful for the present invasion are described in further detail in *Research Disclosure* No. 308, published December 1989, pages 1008–009. Organic matte particles are preferred.

When the matte particles is polymeric in nature, it may include reactive functional groups which form covalent bonds with binders by intermolecular crosslinking or by reaction with a crosslinking agent (i.e., a hardener). Suitable reactive functional groups include hydroxyl, carboxyl, carbodiimide, epoxide, aziridine, vinyl sulfone, sulfinic acid, active methylene, amino, amide, allyl, and the like. There is no particular restriction on the amount of reactive groups present, but their concentrations are preferably in the range of from 0.5 to 10 weight percent. The particle surface may be surrounded with a layer of colloidal inorganic particles as described in U.S. Pat. No. 5,288,598, or a layer of colloidal polymer latex particles which have affinity with suitable binder as described in U.S. Pat. No. 5,279,934, or a layer of gelatin as described in U.S. Pat. No. 4,855,219.

Process removable mattes can be used together with process surviving matte particles in the practice of preferred embodiments of the invention to further enhance the resistance of the photographic element to ferrotyping and blocking. Such process removable matte include particles of, for example, copolymers of alkyl (meth)acrylates and methacrylic acid, or acrylic acid, or itaconic acid, copolymers of alkyl (meth)acrylates and maleic monoesters or monoamides, copolymers of styrene or vinyl toluene and a,b-unsaturated mono- or di-carboxylic acids, or dicarboxylic monoesters or monoamides, graft copolymers containing maleic anhydride or methacrylic acid, and dicarboxylic acid mono-ester of a cellulose derivative, such as phthalate and hexahydro phthalate of methyl cellulose, hydroxyethyl cellulose, or hydroxypropylomethyl cellulose. Such processing soluble mattes are described in further detail, e.g., in U.S. Pat. Nos. 2,992,101; 3,767,448; 4,094,848; 4,447,525; and 4,524,131.

The advantages of the invention are particularly useful wherein the protective overcoat comprises an ultraviolet (UV) absorbing layer positioned between the light sensitive silver halide emulsion layer and the outermost protective layer, especially where the ultraviolet absorbing layer comprises an ultraviolet absorbing dye, a high boiling organic solvent, and a hydrophilic binder. The content of the hydrophilic binder in such a UV layer is defined as the ratio of coating weight of the hydrophilic binder to the sum of the coating weights of the ultraviolet absorbing dyes, high boiling organic solvents, and the hydrophilic binder, and is preferably in the range of from 30 to 90%, and more preferably from 40 to 80%. The thickness of the UV layer in accordance with the preferred embodiment of the present invention is usually 0.2 to 3 $\mu$m, and preferably from 0.5 to 2 $\mu$m. The thickness of the outermost layer is usually 0.4 to 3 $\mu$m, and more preferably 0.6 to 2 $\mu$m. The total thickness of the two layers is usually 1.5 to 4 $\mu$m. The term "thickness" used here refers to the thickness of the portion in which no matte particles are present and is measured, for example, by an electron micrograph of a non-swollen cross-section of the light-sensitive material.

The types of ultraviolet absorbing dyes (UV dyes) used in accordance with preferred embodiments of the invention are not particularly limited provided their absorption maximum wavelengths fall within the range from 300 to 400 nm, and they have no harmful effect on the photographic properties of the element. Such UV dyes include those of the thiazolidone type, the benzotriazole type, the cinnamic acid ester type, the benzophenone type, and the aminobutadiene type and have been described in detail in, for example, U.S. Pat. Nos. 1,023,859; 2,685,512; 2,739,888; 2,748,021; 3,004,896; 3,052,636; 3,215,530; 3,253,921; 3,533,794; 3,692,525; 3,705,805; 3,707,375; 3,738,837; 3,754,919; and British Patent No. 1,321,355. The amount of UV dyes used is preferably in the range of from 0.05 to 1 g/m$^2$, more preferably 0.1 to 0.5 g/m$^2$. The aforementioned UV dyes are so selected as to have an absorption maximum in a wavelength region required for the photographic performance, and are used singly or in combination.

The UV dyes are preferably used in a pre-dispersion form (UV dye dispersion), which can be prepared, for example, by dissolving the UV dye in a high boiling organic solvent and then adding the resulting solution in an aqueous gelatin solution containing a surfactant such as, for example, sodium dodecyl sufonate. The mixture is stirred at high speed to make an emulsified dispersion, and the dispersion is added to the coating liquid, which is then coated. Alternatively, UV dyes which are liquid at room (or slightly elevated) temperature can be emulsified and dispersed without the use of high boiling organic solvent. Typical high boiling organic solvents useful for the present invention have a boiling point of 175° C. or more at atmospheric pressure, and include, for example, phthalic esters, e.g., dibutyl phthalate, dipentyl phthalate, didodecyl phthalate, didecyl phthalate, diethylhexyl phthalate, dicyclohexyl phthalate, phosphanate or phosphanate esters, e.g. tricresyl phosphate, trihexyl phosphate, tri(2-ethyl hexyl) phosphate, tridodecyl phosphate, Benzoate esters, e.g., 2-ethylhexyl benzoate, dodecyl benzoate, 2-ethylhexyl-p-hydroxybenzoate, alcohols and phenols, e.g., p-dodecyl phenol isostearyl alcohol, 2,4-tertamylphenol, aliphatic carboxylate esters, an aniline derivative, and hydrocarbons. High boiling organic solvents which can be used for the practice of the present invention are described further in detail in, for example, U.S. Pat. No. 2,322,027 and WO 94/11787.

Any suitable hydrophilic binder may be used in the outermost layer and the UV layer in practice of the present invention. Gelatin is the most preferred hydrophilic binder. Other hydrophilic binders include both naturally occurring substances such as proteins, protein derivatives, cellulose derivatives (e.g., cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. For crosslinkable binder such as gelatin, the binder is preferably cross-linked so as to provide a high degree of cohesion and adhesion. Crosslinking agents or hardeners which may effectively be used in the coating compositions of the present invention include aldehydes, epoxy compounds, polyfunctional aziridines, vinyl sulfones, methoxyalkyl mealtimes, triazines, polyisocyanates, dioxane derivatives such as dihydroxydioxane, carbodiimides, chrome alum, zirconium sulfate, and the like.

Lubricants may also be used in the outermost layer of the present invention. Typical lubricants include (1) silicone based materials disclosed, for example, in U.S. Pat. Nos. 3,489,567; 3,080,317; 3,042,522; 4,004,927; and 4,047,958; and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc disclosed in U.S. Pat. Nos. 2,454,043; 2,732,305; 2,976,148; 3,206,311; 3,933,516; 2,588,765; 3,121,060; 3,502,473; 3,042,222; and 4,427,964; in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No. 308, published December 1989, page 1006.

The outermost protective layer useful in the practice of the invention may also optionally contain surface active agents, antistatic agents, charge control agents, thickeners, silver halide particles, colloidal inorganic particles, magnetic recording particles, and various other additives. The UV layer useful in the practice of the present invention may optionally contain silver halide particles, antistatic agents, thickeners, surfactants, polymer latex particles, and various other additives.

The protective overcoat layers useful in the practice of the invention can be applied by any of a number of well-know techniques, such as dip coating, rod coating, blade coating, air knife coating, gravure coating and reverse roll coating, extrusion coating, slide coating, curtain coating, and the like. After coating, the protective layers are generally dried by simple evaporation, which may be accelerated by known techniques such as convention heating. Known coating and drying methods are described in further detail in *Research Disclosure* No. 308, published December 1989, pages 1007–1008.

Magnetic layers suitable for use in the elements in accordance with the invention include those as described, e.g., in *Research Disclosure*, November 1992, Item 34390, and U.S. Pat. Nos. 5,395,743; 5,397,826; 5,113,903; 5,432,050; 5,434,037; and 5,436,120. It is also specifically contemplated to use elements in accordance with the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

Photographically transparent magnetic recording layers used in elements in accordance with preferred embodiments of the invention are comprised of magnetic particles dispersed in a film-forming binder. The layer may contain optional additional components for improved manufacturing or performance such as crosslinking agents or hardeners, catalysts, coating aids, dispersants, surfactants, including fluorinated surfactants, charge control agents, lubricants, abrasive particles, filler particles and the like. The magnetic particles of the present invention can comprise ferromagnetic or ferromagnetic oxides, complex oxides including other metals, metallic alloy particles with protective coatings, ferrites, hexaferrites, etc. and can exhibit a variety of particulate shapes, sizes, and aspect ratios. Ferromagnetic oxides useful for magnetic coatings include g-$Fe_2O_3$, $Fe_3O_4$, and $CrO_2$. The magnetic particles optionally can be in solid solution with other metals and/or contain a variety of dopants and can be overcoated with a shell of particulate or polymeric materials. Preferred additional metals as dopants, solid solution components or overcoats are Co and Zn for iron oxides; and Li, Na, Sn, Pb, Fe, Co, Ni, and Zn for chromium dioxide. Surface treatments of the magnetic particle can be used to aid in chemical stability or to improve dispersability as is commonly practiced in conventional magnetic recording. Additionally, magnetic oxide particles may contain a thicker layer of a lower refractive index oxide or other material having a low optical scattering cross-section as taught in U.S. Pat. Nos. 5,217,804 and 5,252,441. Cobalt surface treated g-iron oxide is the preferred magnetic particle.

Suitable polymeric binders for magnetic recording layers include: gelatin; cellulose compounds such as cellulose nitrate, cellulose acetate, cellulose diacetate, cellulose triacetate, carboxymethyl cellulose, hydroxyethyl cellulose, cellulose acetate butyrate, cellulose acetate propionate, cellulose acetate phthalate and the like; vinyl chloride or vinylidene chloride-based copolymers such as, vinyl chloride-vinyl acetate copolymers, vinyl chloride-vinyl acetate-vinyl alcohol copolymers, vinyl chloride-vinyl acetate-maleic acid copolymers, vinyl chloride-vinylidene chloride copolymers, vinyl chloride-acrylonitrile copolymers, acrylic ester-vinylidene chloride copolymers, methacrylic ester-vinylidene chloride copolymers, vinylidene chloride-acrylonitrile copolymers, acrylic ester-acrylonitrile copolymers, methacrylic ester-styrene copolymers, thermoplastic polyurethane resins, thermosetting polyurethane resins, phenoxy resins, phenolic resins, epoxy resins, polycarbonate or polyester resins, urea resins, melamine resins, alkyl resins, urea-formaldehyde resins, and the like; polyvinyl fluoride, butadiene-acrylonitrile copolymers, acrylonitrile-butadiene-acrylic acid copolymers, acrylonitrile-butadiene-methacrylic acid copolymers, polyvinyl alcohol, polyvinyl butyral, polyvinyl acetal, styrene-butadiene copolymers, acrylic acid copolymers, polyacrylamide, their derivatives and partially hydrolyzed products; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of polyurethanes or polyesterionomers. Preferred binders are polyurethanes, vinyl chloride based copolymers, acrylics or acrylamides and cellulose esters, particularly cellulose diacetate and cellulose triacetate.

In addition to a magnetic recording layer, the back side of the support of the elements of the invention may optionally be coated with a wide variety of additional functional or auxiliary layers known in the art such as electrically conductive antistatic layers, abrasion resistant layers, curl control layers, transport control layers, lubricant layers, image recording layers, adhesion promoting layers, and layers to control water or solvent permeability. In a preferred embodiment of the invention, the support backside is coated with at least an antistatic layer and a magnetic recording layer. A lubricant layer may also preferably be coated on the backside. A permeability control layer may also be preferably coated between the antistatic layer and magnetic recording layer.

The photographic element of the present invention preferably contain an electrically conductive antistatic layer, which can be either a surface protective layer or a sub layer. The surface resistivity of at least one side of the support is preferably less than $1\times10^{12}$ Ω/square, more preferably less than $1\times10^{11}$ Ω/square at 25° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

Photographic elements in accordance with the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing on the frontside thereof a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers on the frontside, such as filter layers, interlayers, antihalation layers, overcoat layers, subbing layers, and the like.

In the following discussion of suitable materials for use in the photographic emulsions and elements that can be used in conjunction with the invention, reference will be made to *Research Disclosure*, September 1994, Item 36544, available as described above, which will be identified hereafter by the term "*Research Disclosure*." The Sections hereafter referred to are Sections of the *Research Disclosure*, Item 36544.

The silver halide emulsions employed in the image-forming layers of photographic elements can be either negative-working or positive-working. Suitable emulsions and their preparation as well as methods of chemical and spectral sensitization are described in Sections I, and III-IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI-IX. Layers and layer arrangements, color negative and color positive features, scan facilitating features, supports, exposure and processing can be found in Sections XI-XX.

The photographic material in accordance with a preferred embodiment of the invention is designed for use in association with a cassette, such as shown generally in U.S. Pat. No. 5,173,730, which is incorporated by reference herein, and in the attached FIG. 1. In FIG. 1, photographic element 12 is shown encased in a suitable cassette 14. The cassette includes an inlet/outlet 16 for entrance and exit of the photographic element 12 into and out of the cassette 14. The photographic element 12 may be wound upon a suitable spool 18 or on itself (not shown). Applicants' invention provides advantageous ferrotyping protection for photographic elements which are supplied in such photographic film cassettes, processed (i.e., exposed and developed), and which are subsequently reintroduced into such cassettes after processing.

The present invention is also directed to a single use camera having incorporated therein a photographic element as described above, or a photographic film cassette containing therein such a photographic element. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic material is exposed in a similar manner as any photographic materials are exposed in cameras, and then the product is sent to the developer who removes the photographic material and develops it. Return of the product to the consumer does not normally occur. Single use cameras and their methods of manufacture and use are described in, e.g., U.S. Pat. Nos. 4,801,957; 4,901,097; 4,866,459; 4,849,325; 4,751,536; 4,827,298; European Patent Applications 0 460 400; 0 533 785; 0 537 908; and 0 578 225, all of which are incorporated herein by reference.

The photographic processing steps to which the elements of the invention may be subject after exposure include, but are not limited to, the following:

1) color developing→bleach→fixing washing/stabilizing;
2) color developing→bleaching→fixing washing/stabilizing;
3) color developing→bleaching bleach→fixing →washing/stabilizing;
4) color developing→stopping→washing bleaching→washing fixing→washing/stabilizing;
5) color developing bleach→fixing→fixing→a washing/stabilizing;
6) color developing bleaching bleach→fixing→fixing washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The invention will be further illustrated by the following examples.

Latex particles used in the coating examples are listed in Table 1 together with their mean particle size and composition.

TABLE 1

Polymer Latex Particles

| Particle | Diameter (nm) | Composition |
|---|---|---|
| P-1 | 25.3 | Poly(methyl methacrylate) |
| P-2 | 27.9 | Poly(methyl methacrylate-co-methacrylic acid) 97/3 wt % |
| P-3 | 36.8 | Poly(methyl methacrylate-co-methacrylamide) 95/5 wt % |
| P-4 | 33.9 | Poly(methyl methacrylate-co-N,N-dimethyl acrylamide) 95/5 wt % |
| P-5 | 39.1 | Poly(methyl methacrylate-co-methacrylamide) 90/10 wt % |
| P-6 | 25.3 | Poly(methyl methacrylate-co-sodium acrylamido-2-methylpropane sulfonate) 95/5 wt % |
| P-7 | 35.7 | Poly(methyl methacrylate-co-methacrylamide-co-acetoacetoxyethyl methacrylate) 90/5/5 wt % |

All the latex polymer particles shown in Table 1 have a glass transition temperature of larger than 70° C.

EXAMPLES 1 to 9

Photographic Elements

A series of photographic elements are prepared as follows: A poly(ethylene naphthalate) support is used having an antihalation layer on one side and an antistatic layer overcoated with a photographically transparent magnetic recording layer on the other side. The magnetic recording layer comprised a dispersion of cobalt-modified γ-iron oxide particles in a polymeric binder with a cross-linker and abrasive particles. The polymeric binder was a mixture of cellulose diacetate and cellulose triacetate. Total dry coverage for the magnetic layer was nominally about 1.5 g/m$^2$. The support is coated on the antihalation layer side with the following layers in sequence.

Interlayer: This layer comprises 2,5-di-t-octyl-1,4-dihydroxy benzene (0.075 g/m$^2$), tri(2-ethylhexyl) phosphate (0.113 g/m$^2$), and gelatin (0.86 g/m$^2$).

Slow Cyan Dye-forming Layer: This layer comprises a red sensitive silver bromoiodide emulsion (3.3 mole percent iodide) (0.324 μm grain size) (0.387 g/m$^2$ silver), compound CC-1 (0.355 g/m$^2$), IR-4 (0.011 g/m$^2$), B-1 (0.075 g/m$^2$), S-2 (0.377 g/m$^2$), S-3 (0.098 g/m$^2$), and gelatin (1.64 g/m$^2$).

Mid Cyan Dye-forming Layer: This layer comprises a blend of a red sensitive silver bromoiodide emulsion (3.3 mole percent iodide) (0.488 μm grain size) (0.816 g/m$^2$ silver) and a red sensitive, tabular grain, silver bromoiodide emulsion (4.5 mole percent iodide) (0.98 μm diameter by 0.11 μm thick) (0.215 g/m$^2$ silver), compound CC-1 (0.183 g/m$^2$), IR-3 (0.054 g/m$^2$), B-1 (0.027 g/m$^2$), CM-1, (0.011 g/m$^2$), S-2 (0.183 g/m$^2$), S-3 (0.035 g/m$^2$), S-5 (0.054 g/m$^2$), and gelatin (1.35 g/m$^2$).

Fast Cyan Dye-forming Layer: This layer comprises a red sensitive, tabular grain, silver bromoiodide emulsion (4.5 mole percent iodide) (1.10 μm diameter by 0.11 μm thick) (1.08 g/m$^2$ silver), compound CC-1 (0.161 g/m$^2$), IR-3 (0.038 g/m$^2$), IR-4 (0.038 g/m$^2$), CM-1 (0.032 g/m$^2$), S-2 (0.237 g/m$^2$), S-5 (0.038 g/m$^2$), and gelatin (1.35 g/m$^2$).

Interlayer: This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Magenta Dye-forming Layer: This layer comprises a blend of a green sensitive, tabular grain, silver bromoiodide emulsion (1.5 mole percent iodide) (0.7 μm diameter by 0.112 μm thick) (0.258 g/m$^2$ Ag), and a green sensitive, tabular grain, silver bromoiodide emulsion (1.3 mole percent iodide) (0.54 μm diameter by 0.086 μm thick) (0.409 g/m$^2$ Ag), compound M-1 (0.204 g/m$^2$), MM-1 (0.038 g/m$^2$), ST-1 (0.020 g/m$^2$), S-1 (0.26 g/m$^2$), and gelatin (1.18 g/m$^2$).

Mid Magenta Dye-forming Layer: This layer comprises a green sensitive, tabular grain, silver bromoiodide emulsion (4.5 mole percent iodide) (0.61 μm diameter by 0.12 μm thick) (0.646 g/m$^2$ Ag), compound M-1 (0.099 g/m$^2$), MM-1 (0.027 g/m$^2$), IR-2 (0.022 g/m$^2$), ST-1 (0.010 g/m$^2$), S-1 (0.143 g/m$^2$), S-2 (0.044 g/m$^2$), and gelatin (1.41 g/m$^2$).

Fast Magenta Dye-forming Layer: This layer comprises a green sensitive, tabular grain, silver bromoiodide emulsion (4.5 mole percent iodide) (0.98 μm diameter by 0.113 μm thick) (0.699 g/m$^2$ Ag), compound M-1 (0.052 g/m$^2$), MM-1 (0.032 g/m$^2$), IR-2 (0.022 g/m$^2$), ST-1 (0.005 g/m$^2$), S-1 (0.111 g/m$^2$), S-2 (0.044 g/m$^2$), and gelatin (1.123 g/m$^2$).

Yellow Filter Layer: This layer comprises 2,5-di-toctyl-1,4-dihydroxy benzene (0.075 g/m$^2$), YD-2 (0.108 g/m$^2$), Irganox 1076 sold by Ciba Geigy (0.01 g/m$^2$), S-2 (0.121 g/m$^2$) and gelatin (0.861 g/m$^2$).

Slow Yellow Dye-forming Layer: This layer comprises a blend of a blue sensitive, tabular grain, silver bromoiodide emulsion (4.5 mole percent iodide) (1.4 μm diameter by 0.131 μm thick) (0.161 g/m$^2$ Ag), a blue sensitive, tabular grain, silver bromoiodide emulsion (1.5 mole percent iodide) (0.85 μm diameter by 0.131 μm thick) (0.0.108 g/m$^2$ Ag), and a blue sensitive, tabular grain, silver bromoiodide emulsion (1.3 mole percent iodide) (0.54 μm diameter by 0.086 μm thick) (0.161 g/m$^2$ Ag), compound Y-1 (0.915 g/m$^2$), IR-1 (0.032 g/m$^2$), B-1 (0.0065 g/m$^2$), S-1 (0.489 g/m$^2$), S-3 (0.0084 g/m$^2$), and gelatin (1.668 g/m$^2$).

Fast Yellow Dye-forming Layer: This layer comprises a blue sensitive, tabular grain, silver bromoiodide emulsion (4.5 mole percent iodide) (2.3 μm diameter by 0.128 μm thick) (0.43 g/m$^2$ Ag), compound Y-1 (0.15 g/m$^2$), IR-1 (0.032 g/m$^2$), B-1 (0.0054 g/m$^2$), S-1 (0.091 g/m$^2$), S-3 (0.0070 g/m$^2$), and gelatin (0.753 g/m$^2$).

UV Protective Layer: Various compositions according to Table 2.

Outermost Protective Layer: Various compositions according to Table 3.

Y-1

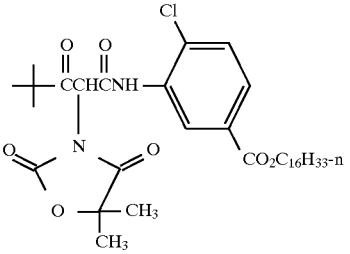

IR-1

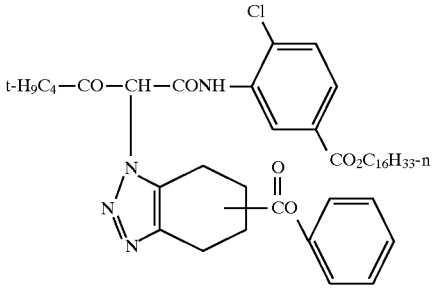

-continued

YD-2

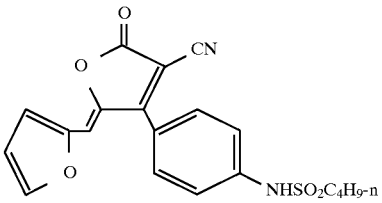

ST-1

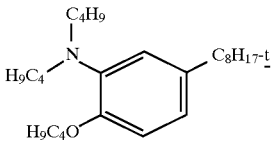

IR-2

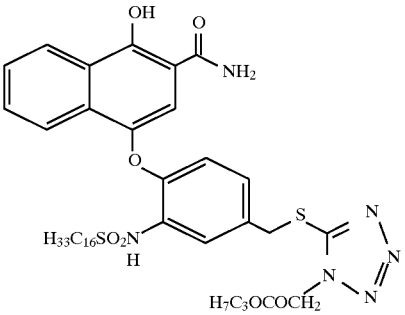

IR-3

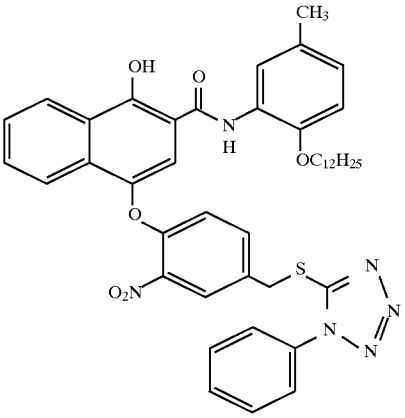

IR-4

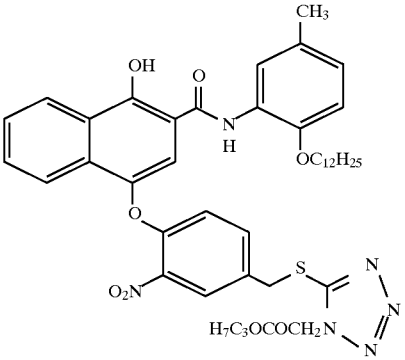

-continued

B-1

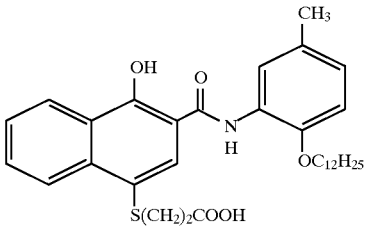

M-1

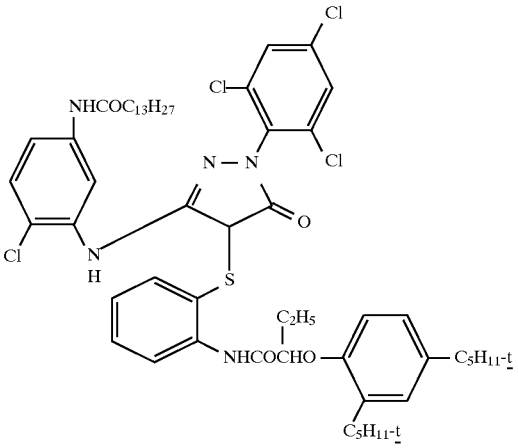

MM-1

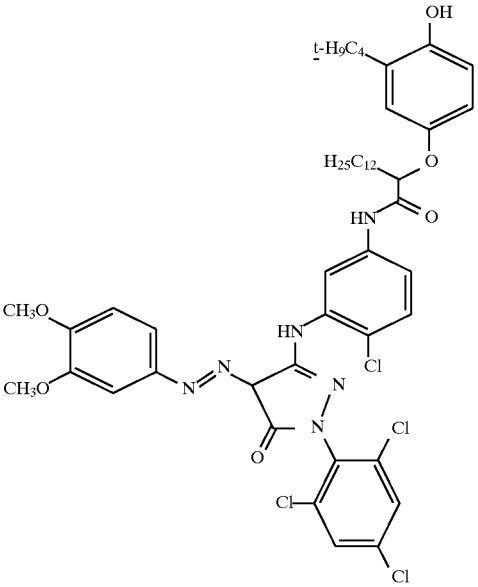

CC-1

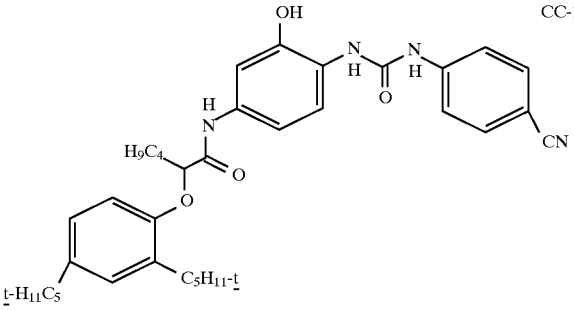

-continued

CM-1

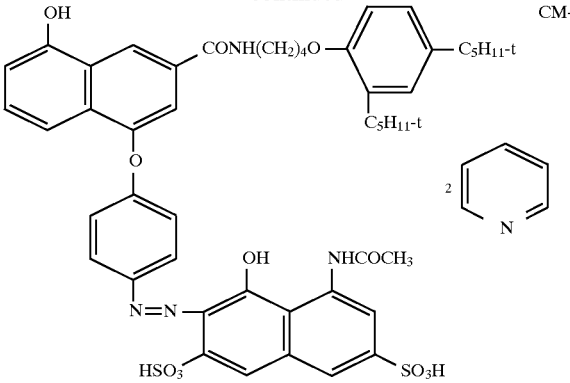

S-1

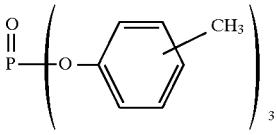

S-2

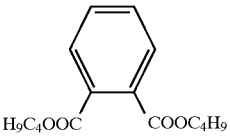

S-3

$C_{11}H_{23}CON(C_2H_5)_2$

S-4

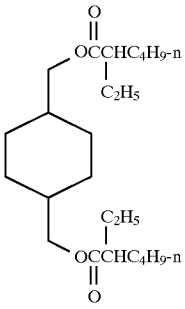

S-5

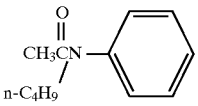

UV-1

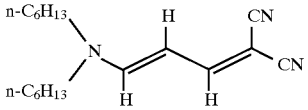

UV-2

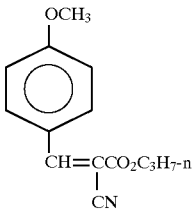

In forming the UV layer, dyes UV-1 and UV-2 are dissolved in S-1 solvent and the resultant solutions are dispersed in aqueous gelatin solutions by using a homogenizer at 3500 psi and at 45° C. The dispersions are then used to form the coating solutions. The coating examples will be presented in terms of dry coating compositions.

TABLE 2

| Composition of the UV Protective layer | |
|---|---|
| Gelatin, lime processed | 0.7 g/m$^2$ |
| Colloidal Silver | 0.215 g/m$^2$ |
| High boiling organic solvent S-1 | in Table 4 |
| UV-1 | in Table 4 |
| UV-2 | in Table 4 |

TABLE 3

| Composition of the Outermost Protective Layer | |
|---|---|
| Gelatin, lime processed | 888 mg/m$^2$ |
| Silicone lube, DC-200 (Dow Corning) | 40.1 mg/m$^2$ |
| Fluorad FC-134 (3M Co.) | 3.9 mg/m$^2$ |
| Aerosol OT (American Cyanamide) | 21.5 mg/m$^2$ |
| Surfactant Olin 10G (Olin Corp.) | 27.2 mg/m$^2$ |
| Poly(vinyl toluene-co-divinyl benzene) 80/20 wt % 1.5 $\mu$m | 53.8 mg/m$^2$ |
| Poly(methyl methacrylate-co-methacrylic acid) 45/55 wt % 2.7 $\mu$m | 108 mg/m$^2$ |
| Latex polymer particle (Table 4) | In Table 4 |

Table 4 shows the compositions of the UV and outermost protective layers of each photographic element prepared.

TABLE 4

| | Outermost Protective Layer | | UV Protective Layer | | |
|---|---|---|---|---|---|
| Example | Polymer | Coverage mg/m$^2$ | UV-1 mg/m$^2$ | UV-2 mg/m$^2$ | Solvent mg/m$^2$ |
| Example 1 (Comparison) | — | — | 106 | 106 | 151 |
| Example 2 (Comparison) | — | — | 49.4 | 49.4 | 68 |
| Example 3 (Comparative) | — | — | 0 | 0 | 0 |
| Example 4 (Comparison) | P-1 | 323 | 106 | 106 | 151 |
| Example 5 (Comparison) | P-2 | 323 | 106 | 106 | 151 |
| Example 6 (Comparison) | P-6 | 323 | 106 | 106 | 151 |
| Example 7 (Invention) | P-4 | 323 | 106 | 106 | 151 |
| Example 8 (Invention) | P-3 | 323 | 106 | 106 | 151 |
| Example 9 (Invention) | P-5 | 323 | 106 | 106 | 151 |

Evaluation of Surface Defects

The appearance of surface defects is evaluated by using scanning electron microscope. Surface defects or bumps larger than 5 $\mu$m are considered to be harmful to photographic properties and printable or visible in prints or projections. The results are reported in terms of "many" or "none". "Many" indicates that there are numerous surface defects caused by the presence of latex polymer particles. "None" indicates that no surface defects larger than 5 $\mu$m are present.

Evaluation of Ferrotyping Resistance

A group of six strips of the feature film (processed) are placed in a 80 percent relative humidity (RH) chamber for a minimum of 16 hours. The strips are stacked, sensitized side to unsensitized side and wrapped in foil, placed inside a moisture proof wrap, and sealed. The sealed package is then placed above a flat glass plate and under a brass bar of the same size with weight of 6.89 Kgs (15 lbs). The package, with the glass plate and brass bar is then placed in a 37.8° C. (100° F.) room for 17 hours. After storage, the bag is opened, the top and bottom strips are discarded, and the remaining strips are visually inspected for ferrotyping against the following scale:

| Value | % of area showing ferrotyping |
|---|---|
| A | 0 to <5 |
| B | 5 to <20 |
| C | 20 to <50 |
| D | 50 to 100 |

The testing results are reported in Table 5.

TABLE 5

| | | Ferrotyping Resistance | |
|---|---|---|---|
| Example | Surface Defects | Processed 80% RH (harsh*) | Processed 80% RH (mild**) |
| Example 1 (Comparison) | None | D | B |
| Example 2 (Comparison) | None | D | B |
| Example 3 (Comparison) | None | D | A |
| Example 4 (Comparison) | Many | B | A |
| Example 5 (Comparison) | Many | B | A |
| Example 6 (Comparison) | None | C | A |
| Example 7 (Invention) | None | B | A |
| Example 8 (Invention) | None | B | A |
| Example 9 (Invention) | None | B | A |

*processed film strips are dried at 60° C.
**processed film strips are dried at 40° C.

As shown in Table 5, the photographic elements (Examples 7 to 9) prepared in accordance with the present invention show excellent ferrotyping protection and surface quality. Comparative Examples 1–3 do not contain a high Tg polymer latex in the outermost protective layer, and accordingly do not exhibit surface defects. Comparative Examples 1 and 2 contain ultraviolet absorbing dyes and organic solvent in the UV protective layer, and show poor post process ferrotyping resistance. Comparative Example 3 contains no ultraviolet absorbing dyes and organic solvent in the UV protective layer, and shows better ferrotyping protection when processed under mild conditions, but still poor performance when processed under harsh conditions. Additionally, Example 3 has no protection against ultraviolet light. Comparative Examples 4 and 5 contain in their outermost protective layers a poly(methyl methacrylate) latex and a poly(methyl methacrylate-co-methacrylic acid) 97/3 wt % latex, respectively. The use of such latex particles in the surface protective layer has resulted in many surface defects. Comparative Example 6 contains a poly(methyl methacrylate-co-acrylamido-2-methylpropane sulfonic acid, sodium salt) 95/5 wt % latex dispersion. Although the latex does not cause surface defects, the resultant element has an inferior ferrotyping resistance.

EXAMPLES 10 to 14

Photographic Elements

A series of photographic elements are prepared as above. The UV protective layer is prepared according to the composition in Table 6 and coated on the top of the fast yellow dye forming layer. The outermost protective layer is prepared according to the composition in Table 7 and coated on the top of the UV protective layer.

In forming the UV layer of the present invention, the UV-1 and UV-2 are dissolved in S-1 solvent and the resultant solutions are dispersed in aqueous gelatin solutions by using a homogenizer at 3500 psi and at 45° C. The dispersions are then used to form the coating solutions. The coating examples will be presented in terms of dry coating compositions.

TABLE 6

| Composition of the UV Protective layer | |
|---|---|
| Gelatin | 0.7 g/m$^2$ |
| Colloidal Silver | 0.215 g/m$^2$ |
| UV-1 | in Table 4 |
| UV-2 | in Table 4 |

TABLE 7

| Composition of the Outermost Protective Layer | |
|---|---|
| Gelatin, lime processed | 888 mg/m$^2$ |
| Silicone lube, DC-200 (Dow Corning) | 40.1 mg/m$^2$ |
| Fluorad FC-134 (3M Co.) | 3.9 mg/m$^2$ |
| Aerosol OT (American Cyanamide) | 21.5 mg/m$^2$ |
| Surfactant Olin 10G (Olin Corp.) | 27.2 mg/m$^2$ |
| Matte 1, Poly(methyl methacrylate), 1.5 $\mu$m | 53.8 mg/m$^2$ |
| Matte 2, Poly(methyl methacrylate), 0.8 $\mu$m | Table 8 |
| Poly(methyl methacrylate-co-methacrylic acid) 45/55 wt % 2.7 $\mu$m | 108 mg/m$^2$ |
| Latex polymer particle (Table 4) | 323 mg/m$^2$ |

Table 8 shows the compositions of the protective layer of each photographic element prepared.

TABLE 8

| | Outermost Protective Layer | | | UV Protective Layer | |
|---|---|---|---|---|---|
| Example | Matte 2 mg/m$^2$ | Polymer latex | Coverage mg/m$^2$ | UV-1 mg/m$^2$ | UV-2 mg/m$^2$ |
| Example 10 (Comparison) | — | — | — | 106 | 106 |
| Example 11 (Comparison) | 161.4 | — | — | 106 | 106 |
| Example 12 (Comparison) | — | — | — | 0 | 0 |
| Example 13 (Invention) | — | P-7 | 323 | 106 | 106 |
| Example 14 (Invention) | — | P-3 | 323 | 106 | 106 |

Post Process Film Surface Gloss Evaluation

Post process film surface gloss is evaluated in accordance with ASTM Method D523-89 at an angle of 20 degrees. The surface gloss is rated against the following scale:

| Rating | Surface Gloss |
|---|---|
| Exc. | ≧50 |
| Good | ≧35 and <50 |
| Poor | <35 |

Evaluation of UV Spark Protection

Two strips of film (305 mm (12 inches)×35 mm) are exposed to a continuous 5000K daylight source, with only light from 400 to 700 nm used. A step tablet is used to attenuate light and provides a stepped exposure as per ANSI Std PH 2.27—1971. The photographic speed of the topmost light sensitive record is computed in accordance with that standard. A second pair of strips of the same film is exposed to a light source which transmits light from 300 nm to 400 nm (also called the ultraviolet region), using the same step tablet as in the first set of exposures. The photographic speed of the topmost record is computed in a similar manner. The difference in speed between the daylight exposure and the ultraviolet only exposure is a measure of the absorption of the materials contained in the overcoats. UV spark protection is said to be acceptable (pass) when the difference in speed is larger than 60, and unacceptable (fail) when the difference in speed is less than 60.

Evaluation of Ferrotyping Resistance

A group of six strips of the feature film (processed) are placed in a 80 percent relative humidity (RH) chamber for a minimum of 16 hours The strips are stacked, sensitized side to unsensitized side and wrapped in foil, placed inside a moisture proof wrap, and sealed. The sealed package is then placed above a flat glass plate and under a brass bar of the same size with weight of 6.89 Kgs (15 lbs). The package, with the glass plate and brass bar is then placed in a 37.8° C. (100° F.) room for 17 hours. After storage, the bag is opened, the top and bottom strips are discarded, and the remaining strips are visually inspected for ferrotyping against the following scale:

| Value | % of area showing ferrotyping |
|---|---|
| A | 0 to <5 |
| B | 5 to <20 |
| C | 20 to <50 |
| D | 50 to 100 |

The testing results are reported in Table 9.

TABLE 9

| | | | Ferrotyping Resistance | |
|---|---|---|---|---|
| Example | Surface Gloss | UV Protection | Processed 80% RH (harsh*) | Processed 80% RH (mild**) |
| Example 10 (Comparison) | Excellent | Pass | D | B |
| Example 11 (Comparison) | Poor | Pass | B | A |
| Example 12 (Comparison) | Excellent | Fail | D | B |
| Example 13 (Invention) | Excellent | Pass | B | A |
| Example 14 (Invention) | Excellent | Pass | B | A |

TABLE 9-continued

| Example | Surface Gloss | UV Protection | Ferrotyping Resistance Processed 80% RH (harsh*) | Processed 80% RH (mild**) |
|---|---|---|---|---|

*processed film strips are dried at 60° C.
**processed film strips are dried at 40° C.

As shown in Table 9, the photographic elements (Examples 13 and 14) prepared in accordance with the present invention show excellent surface gloss, good UV spark protection, and excellent ferrotyping protection. Comparative Examples 10 does not contain a high Tg latex particle in its protective layer and show poor post process ferrotyping resistance. Comparative Example 11 contains in its protective layer matte particles of two different nominal sizes (bimodal) and shows good ferrotyping protection. However, post process film surface gloss is very low. Comparative Example 12 shows no protection against UV light and poor post process ferrotyping protection.

EXAMPLES 15 and 16

Photographic Elements

The photographic elements are prepared as described above except the protective layer compositions which are listed in Tables 10 and 11.

TABLE 10

| Composition of the UV Protective layer | |
|---|---|
| Gelatin, lime processed | 700 mg/m$^2$ |
| Colloidal Silver | 215 mg/m$^2$ |
| UV-1 | 106 mg/m$^2$ |
| UV-2 | 106 mg/m$^2$ |

TABLE 11

| Composition of the Outermost Protective Layer | |
|---|---|
| Gelatin, lime processed | 888 mg/m$^2$ |
| Silicone lube, DC-200 (Dow Corning) | 40.1 mg/m$^2$ |
| Fluorad FC-134 (3M Co.) | 3.9 mg/m$^2$ |
| Aerosol OT (American Cyanamide) | 21.5 mg/m$^2$ |
| Surfactant Olin 10G (Olin Corp.) | 27.2 mg/m$^2$ |
| Poly(methyl methacrylate), 1.5 $\mu$m | 53.8 mg/m$^2$ |
| Poly(methyl methacrylate-co-methacrylic acid) 45/55 wt % 2.7 $\mu$m | 108 mg/m$^2$ |
| Latex polymer particle (Table 8) | 322.9 mg/m$^2$ |

Negative Return in Cartridge (NRIC) Testing

Films are slit to 24 mm width, exposed to 1.0 neutral density and processed in Process C41. The processed film is then conditioned to 80% RH and loaded into cartridges designed for Advanced Photographic System to simulate reloading in a high humidity environment. The reload cartridges are then stored at 26.7° C. (80° F.) for 2 days, after which they are evaluated for the percentage of area that shows surface ferrotyping against the following scale:

| Value | % of area showing ferrotyping |
|---|---|
| A | 0 |
| B | >0 to <5 |
| C | 5 to <20 |
| D | 20 to <50 |
| E | 50 to 100 |

The testing results are reported in Table 12.

| Example | Polymer Latex | NRIC Ferrotyping |
|---|---|---|
| Example 15 (Comparison) | — | B |
| Example 16 (Invention) | P-3 | A |

The comparison example 15 contains no hard latex particles in its surface protective layer, and therefore shows poorer post process NRIC ferrotyping resistance. On the other hand, Example 16 prepared in accordance with the present invention shows excellent post process NRIC ferrotyping protection.

What is claimed is:

1. A silver halide photographic element comprising a support having a front and a back side, at least one light-sensitive silver halide emulsion layer and a light-insensitive protective overcoat on the front side of the support, and a magnetic recording layer on the back side of the support, the light-insensitive protective overcoat comprising an outermost protective layer, wherein:

the outermost protective layer comprises a hydrophilic binder and dispersed particles having a mean size of less than 0.4 $\mu$m of a polymer having a glass transition temperature of at least 70° C. comprising units derived from monomers A and B at a weight ratio of A:B of from 97:3 to 80:20 and less than 3 wt % ionic monomers, where A represents ethylenically unsaturated monomers which form substantially water insoluble homopolymers and B represents ethylenically unsaturated non-ionic monomers capable of forming water soluble homopolymers.

2. The element of claim 1 wherein the light-insensitive protective overcoat further comprises an ultraviolet absorbing layer.

3. The element of claim 2 wherein the ultraviolet absorbing layer is positioned between the light sensitive silver halide emulsion layer and the outermost protective layer, and comprises an ultraviolet absorbing dye, a high boiling organic solvent, and a hydrophilic binder.

4. The element of claim 3 wherein the high boiling organic solvent has a boiling point greater than 175° C. at atmospheric pressure.

5. The element of claim 3 wherein the hydrophilic binder of both the ultraviolet layer and the outermost protective layer is gelatin.

6. The element of claim 3 wherein the ultraviolet absorbing dye is present in a coverage of from 0.05 to 1 g/m$^2$.

7. The element of claim 1 wherein the outermost protective layer further comprises insoluble matte particles having a mean particle size of larger than 0.5 $\mu$m.

8. The element of claim 7 wherein the insoluble matte particles have a mean particle size of from 0.5 to 10 $\mu$m and the dispersed polymer particles have a mean particle size of from 0.01 to 0.2 $\mu$m.

9. The element of claim 1 wherein the dispersed polymer particles have a mean particle size of from 0.01 to 0.2 $\mu$m.

10. The element of claim 1 where the dispersed polymer particles have a mean particle size of from 0.02 to 0.15 $\mu$m.

11. The element of claim 1 wherein the dispersed polymer particles have a Tg of at least 80° C.

12. The element of claim 1 wherein the outermost layer also contains matte particles that are soluble in processing solutions.

13. The element of claim 1 wherein the dispersed polymer comprises from 80–97 weight percent A monomers, 3–20 weight percent B monomers, and less than 3 weight percent ionic monomers.

14. The element of claim 1 wherein the dispersed polymer comprises from 85–95 weight percent A monomers, 5–15 weight percent B monomers, and less than 1 weight percent ionic monomers.

15. The element of claim 1 wherein the dispersed polymer comprises from 90–95 weight percent A monomers, 5–10 weight percent B monomers, and less than 1 weight percent ionic monomers.

16. The element of claim 1 wherein the dispersed polymer comprises a copolymer of alkyl (meth)acrylates and (meth) acrylamides.

17. The element of claim 16 wherein the dispersed polymer comprises copolymer of methyl methacrylate and methacrylamide or N,N-dimethyl acrylamide.

18. The element of claim 17 wherein the dispersed polymer comprises a poly(methyl methacrylate-co-methacrylamide).

19. The element of claim 1 wherein the dispersed polymer particles are crosslinked.

20. The element of claim 1 wherein the weight ratio of the dispersed polymer to hydrophilic binder in the outermost protective layer ranges from 20:80 to 40:60.

21. A process comprising exposing and developing a photographic element according to claim 1 supplied in a photographic film cassette, and reintroducing the resulting developed element into the photographic film cassette.

22. A photographic film cassette containing an exposed and developed photographic element obtained from the process of claim 21.

23. The photographic film cassette of claim 22 wherein the developed photographic element in the cassette is wound upon itself.

24. The photographic film cassette of claim 22 wherein the developed photographic element in the cassette is wound upon a spool.

* * * * *